US006616245B2

(12) United States Patent
Chang

(10) Patent No.: US 6,616,245 B2
(45) Date of Patent: Sep. 9, 2003

(54) BATHING BRUSH FABRICATION METHOD

(76) Inventor: Che-Yuan Chang, No. 1, Lane 147, Sec. 2, Chung San Rd., Yun Lin, Chang Hua Hsien (TW)

( * ) Notice: Subject to any disclaimer, the term of this patent is extended or adjusted under 35 U.S.C. 154(b) by 0 days.

(21) Appl. No.: 09/818,835

(22) Filed: Mar. 28, 2001

(65) Prior Publication Data

US 2002/0140280 A1 Oct. 3, 2002

(51) Int. Cl.[7] ..... A46D 3/00; A47K 7/02

(52) U.S. Cl. ..... 300/21; 15/209.1; 15/227; 15/229.11

(58) Field of Search ..... 15/209.1, 223, 15/227, 229.11, 229.12; 300/21

(56) References Cited

U.S. PATENT DOCUMENTS 1,689,207 A * 10/1928 Kingman ..... 15/229.11
4,462,135 A * 7/1984 Sanford ..... 15/229.12 X
4,893,371 A * 1/1990 Hartmann ..... 15/229.11
6,149,243 A * 11/2000 Chang ..... 300/21

* cited by examiner

*Primary Examiner*—Mark Spisich
(74) *Attorney, Agent, or Firm*—Browdy and Neimark, P.L.L.C.

(57) ABSTRACT

A bathing brush fabrication method includes the steps of (a) preparing at least one springy meshed tube concentrically arranged together, (b) turning a first end of the at least one springy meshed tube inside out toward a second end thereof and then turning the second end inside out over the first open end to form a combined end at one end and a folded end at the other end, (c) repeatedly folding combined end inside out to form a folded body having an inner layer and an outer layer, (e) preparing a flexible loop, and then inserting a part of the flexible loop in between the inner layer and outer layer of the folded body, and (f) fixedly fastening at least a part of the inner layer and the outer layer to a part of the flexible loop.

11 Claims, 8 Drawing Sheets

BATHING BRUSH FABRICATION METHOD

BACKGROUND OF THE INVENTION

The present invention relates to bathing brushes, more specifically, to a method of fabricating a bathing brush.

Various spherical bathing implements have been disclosed, and have appeared on the market. According to a conventional spherical bathing implement fabrication method, springy meshed tubes are sleeved onto a mold and stretched, and then loaded springy meshed tubes are processed into a finished spherical bathing implement through folding, turning, binding, and cutting steps. A spherical bathing implement made according to this fabrication method does not fit all persons. A spherical bathing implement fits the palm of an adult does not fit the palm of a young child. If a spherical bathing implement is not equipped with retainer means for the positioning of the fingers, it slips from the hand easily. Further, the monotonous configuration of a spherical bathing implement cannot attract consumers to buy. In order to eliminate the aforesaid drawbacks, the inventor of the present invention has invented fruit-shaped bathing balls, and the related inventions have been allowed in the U.S.A. and Japan (U.S. Pat. No. 6,149,243; Japanese Patent #3069047). Because the fabrication of the fruit-shaped bathing balls does not use a mold, the manufacturing cost is greatly reduced.

SUMMARY OF THE INVENTION

It is one object of the present invention to provide a bathing brush fabrication method, which eliminates the use of a special designed tool. It is another object of the present invention to provide a bathing brush fabrication method, which is practical for making bathing brushes of different attractive designs. It is still another object of the present invention to provide a bathing brush fabrication method, which is practical for making bathing brushes that can be positively easily held in the hand for easy use. According to one embodiment of the present invention, the bathing brush fabrication method includes the steps of (a) preparing at least one springy meshed tube concentrically arranged together, (b) turning a first end of the at least one springy meshed tube inside out toward a second end thereof and then turning the second end inside out over the first open end to form a combined end at one end and a folded end at the other end, (c) repeatedly folding combined end inside out to form a folded body having an inner layer and an outer layer, (e) preparing a flexible loop, and then inserting a part of the flexible loop in between the inner layer and outer layer of the folded body, and (f) fixedly fastening at least a part of the inner layer and the outer layer to a part of the flexible loop.

BRIEF DESCRIPTION OF THE DRAWINGS

FIGS. from 1 through 5 illustrate the fabrication procedure of a first embodiment of the present invention.

DETAILED DESCRIPTION OF THE PREFERRED EMBODIMENT

A bathing brush fabrication method in accordance with the present invention is outlined hereinafter with reference to FIGS. from 1 through 6.

Figure 1:
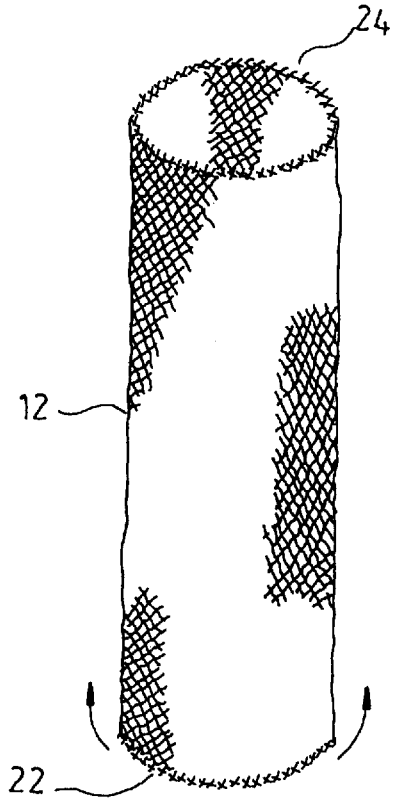

The first step of the bathing brush fabrication method is to prepare a springy meshed tube 12 having a first open end 22 and a second open end 24 (see FIG. 1). The springy meshed tube 12 has a certain length, and a wrinkled surface. If desired, the springy meshed tube 12 can be colored with a particular color or colors.

Figure 2:
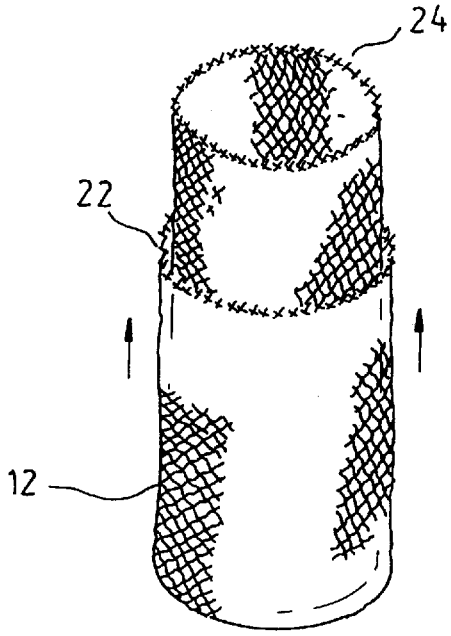
Figure 3:
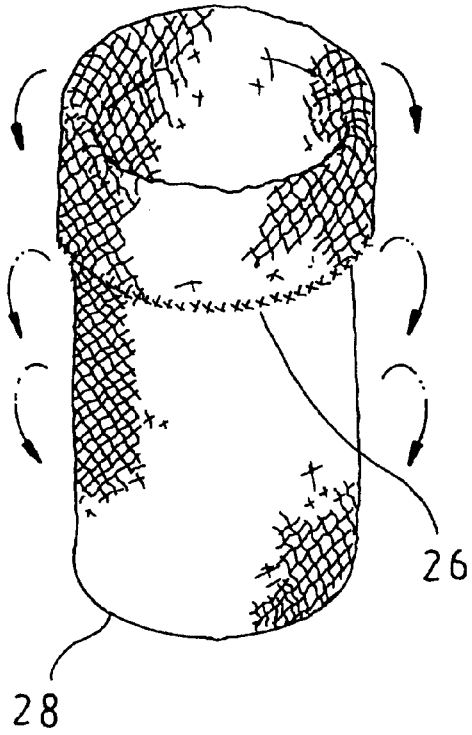

The second step of the bathing brush fabrication method is to sleeve the springy meshed tube 12 onto support means (not shown). The support means can be a rod member or the arm of a person. After loading of the springy meshed tube 12 on support means, the first open end 22 of the springy meshed tube 12 is turned inside out and pulled toward the second open end 24 (see FIGS. 1 and 2), and then the second open end 24 is turned inside out and covered over the first open end 22, enabling the two open ends 22 and 24 to form a combined end 26 and the other end of the springy meshed tube 12 to form a folded end 28 (see FIG. 3).

Figure 4:
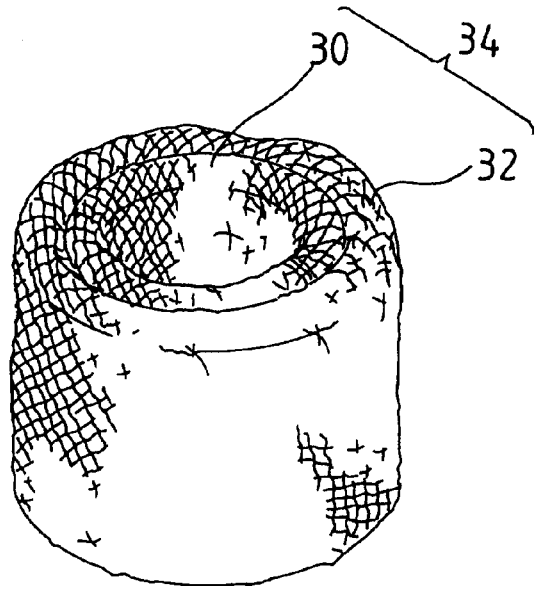

The third step of the bathing brush fabrication method is to repeatedly turn the combined end 26 inside toward the folded end 28 to form a folded body 34 having an inner layer 30 and an outer layer 32 (see FIG. 4).

Figure 5:
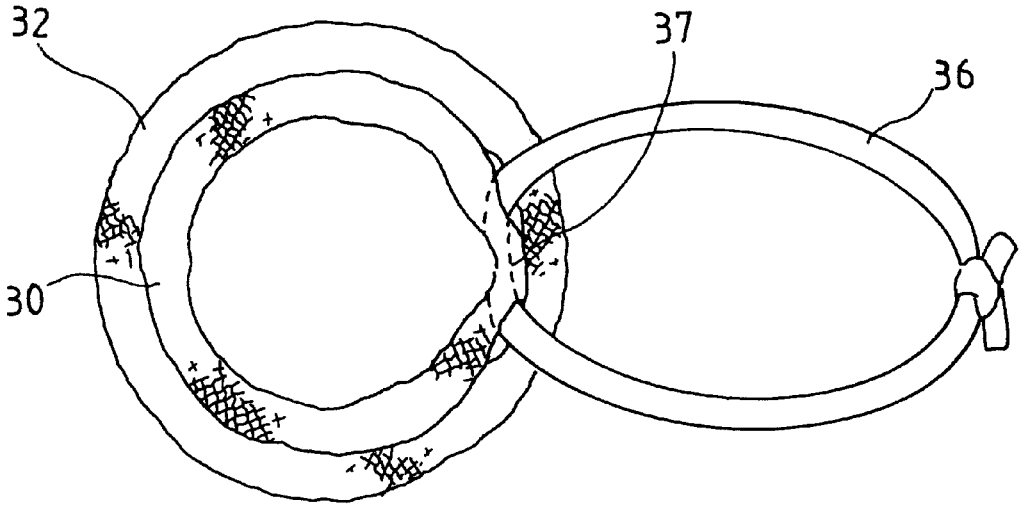
Figure 6:
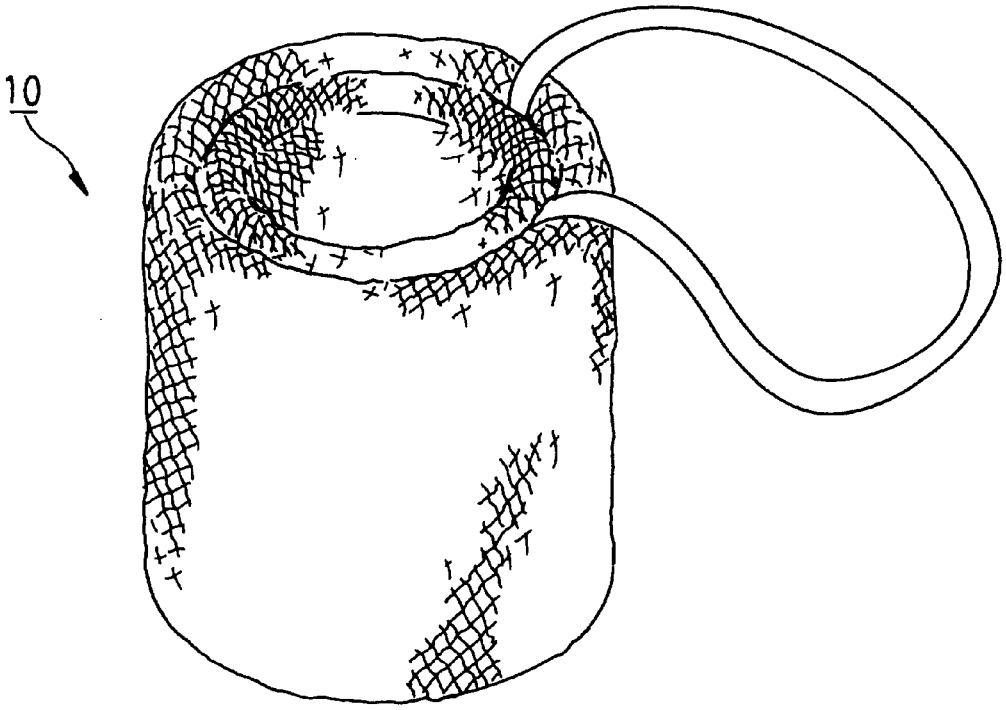
FIG. 6 is an elevational view of a bathing brush constructed according to the first embodiment of the present invention.

The fourth step of the bathing brush fabrication method is to insert a part 37 of a flexible loop 36 into the folded body 34 between the inner layer 30 and the outer layer 32, and then to fixedly fasten the inner layer 30, the outer layer 32 and the part 37 of the flexible loop 36 together by fusion (see FIG. 5). After connection of the flexible loop 36 to the inner layer 30 and the outer layer 32, a finished bathing brush 10 is obtained (see FIG. 6).

When in use, the hand is inserted through the flexible loop 36 into the inside of the folded body 34, and then rub the bathing brush 10 over the body.

Figure 7:
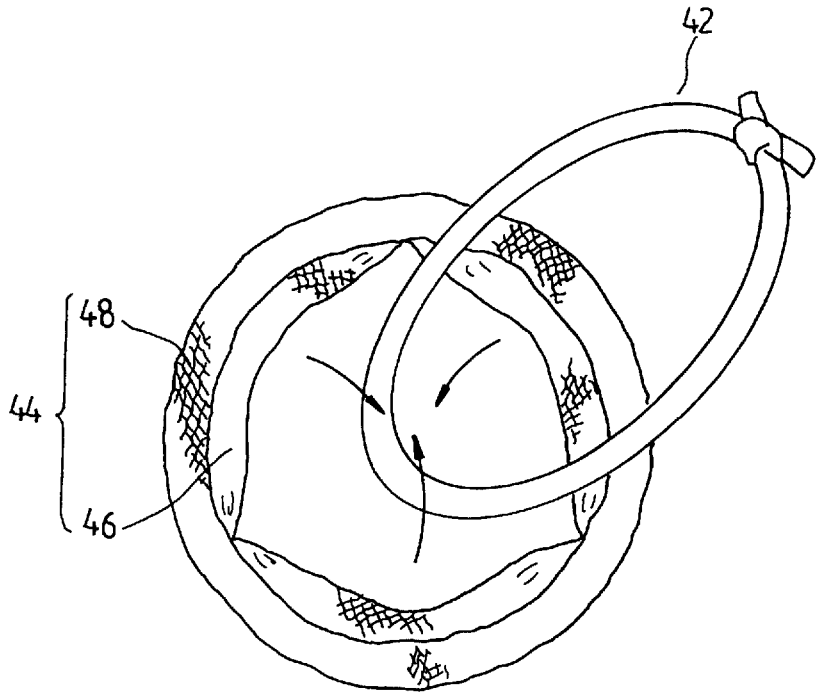
FIG. 7 illustrates the relationship between the folded body and the flexible loop according to a second embodiment of the present invention.
Figure 8:
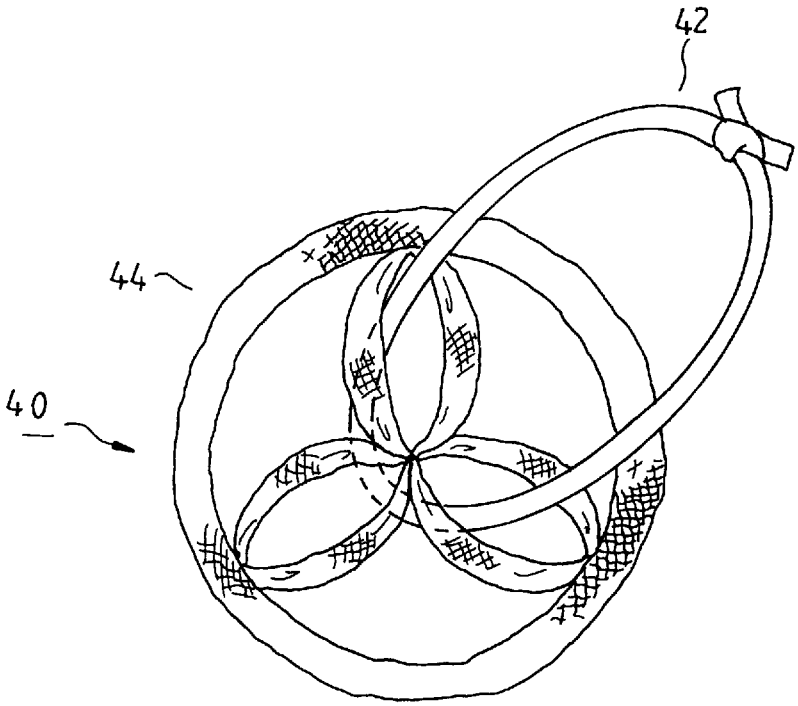
FIG. 8 is an end view of a bathing brush constructed according to the second embodiment of the present invention.

Referring to FIGS. 7 and 8, the flexible loop 42 can be disposed at the hollow center of the folded body 44, and then the inner layer 46 and the outer layer 48 and the flexible loop 42 are sealed together by fusion at three locations, and then a part of the inner layer 46 of the folded body 44 is sealed to an inner side of the flexible loop 42. When viewed from one end of the bathing brush 40, a triangular pattern is shown within the folded body 44 (see FIG. 8).

Figure 9:
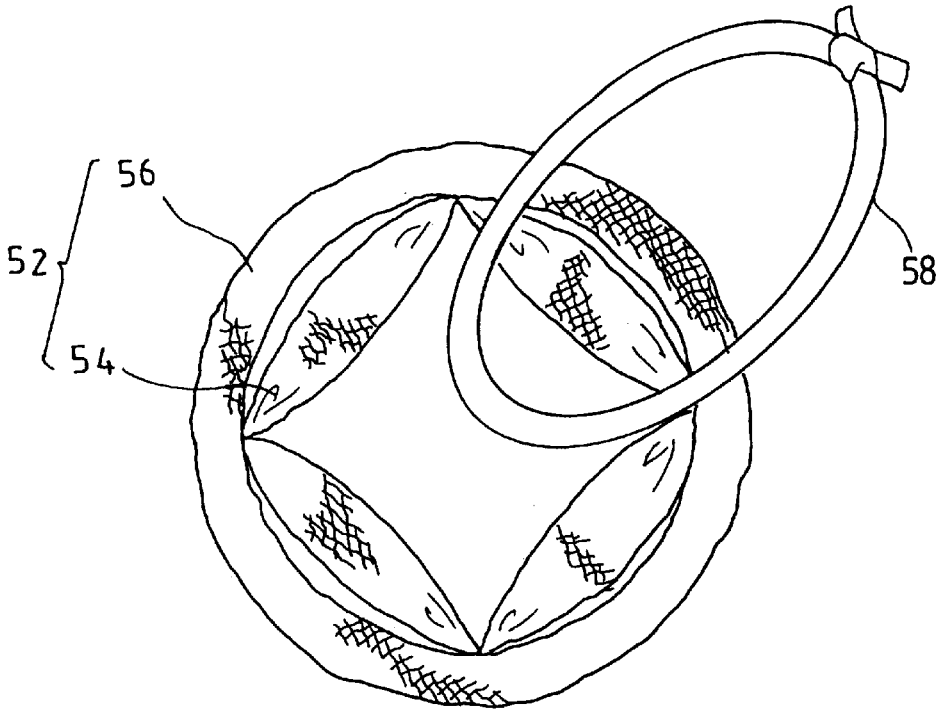
FIG. 9 illustrates the relationship between the folded body and the flexible loop according to a third embodiment of the present invention.
Figure 10:
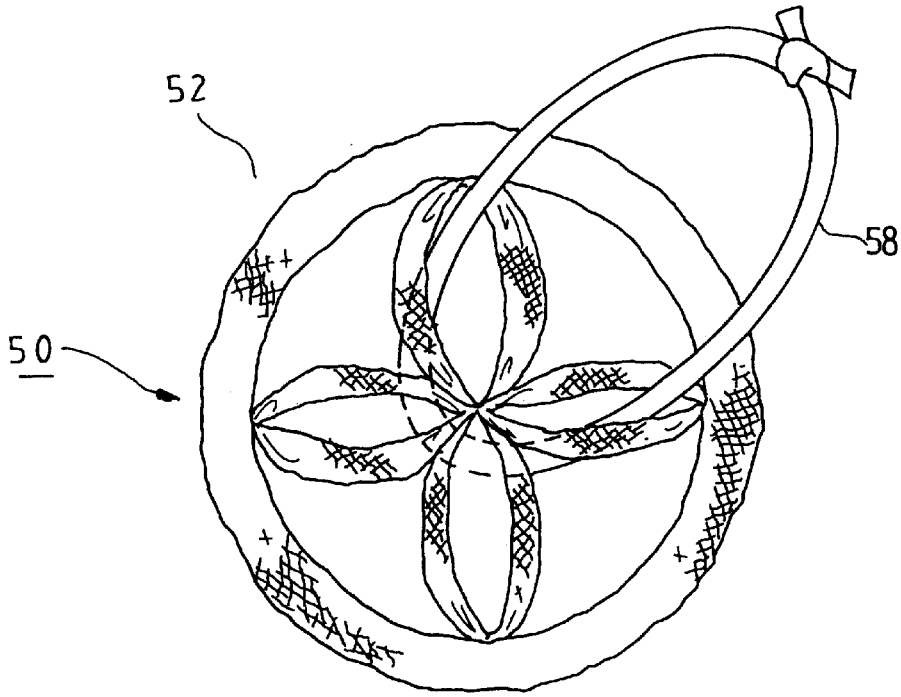
FIG. 10 is an end view of a bathing brush constructed according to the third embodiment of the present invention.

Referring to FIGS. 9 and 10, the inner layer 54 and outer layer 56 of the folded body 52 are sealed together at four equiangularly spaced points, and then a part of the inner layer 54 is sealed to the flexible loop 58. When viewed from one end of the bathing brush 50, a four-petal flower bud pattern is shown within the folded body 52.

Figure 11:
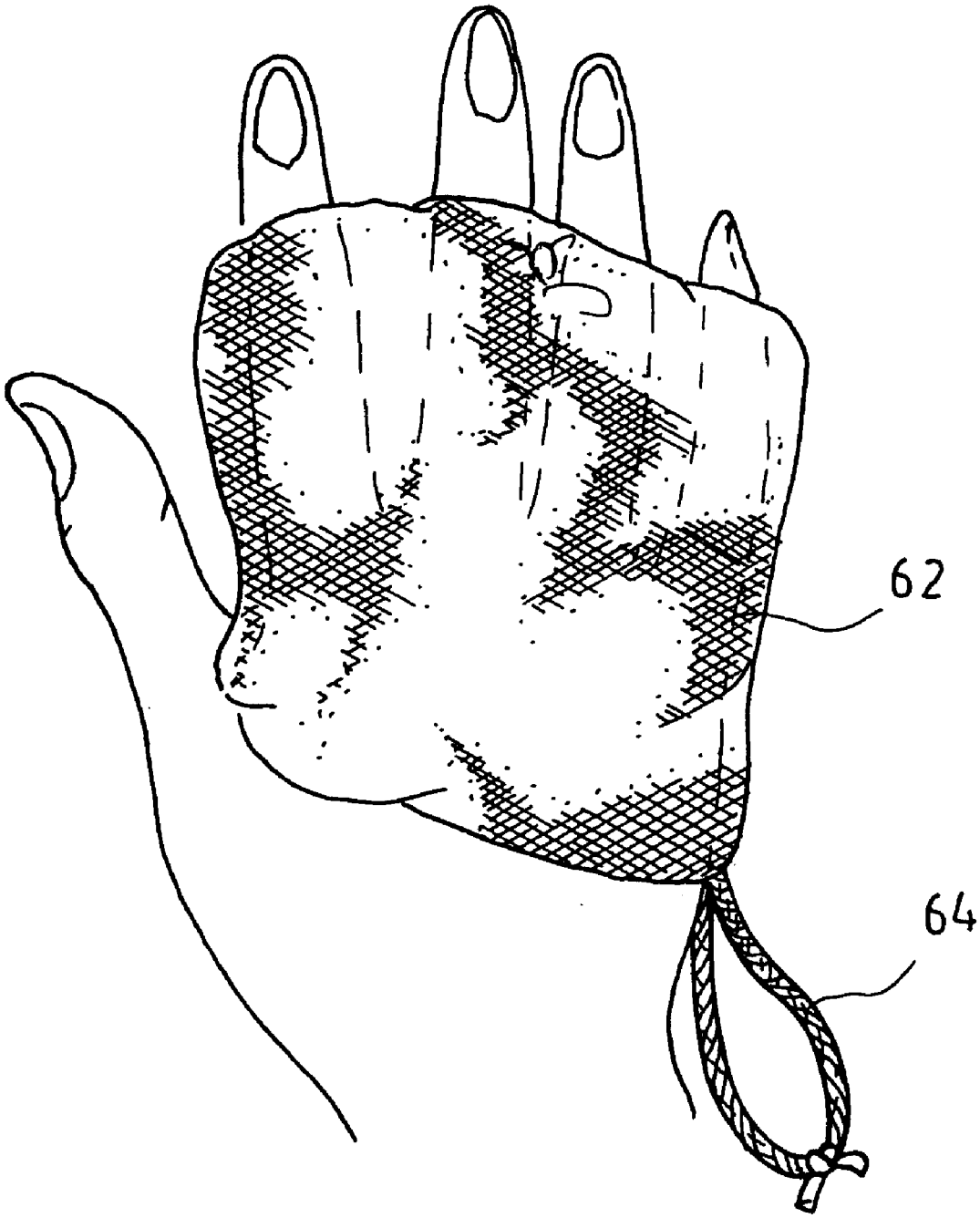
FIG. 11 is an applied view of a bathing brush constructed according to a fourth embodiment of the present invention.
Figure 12:
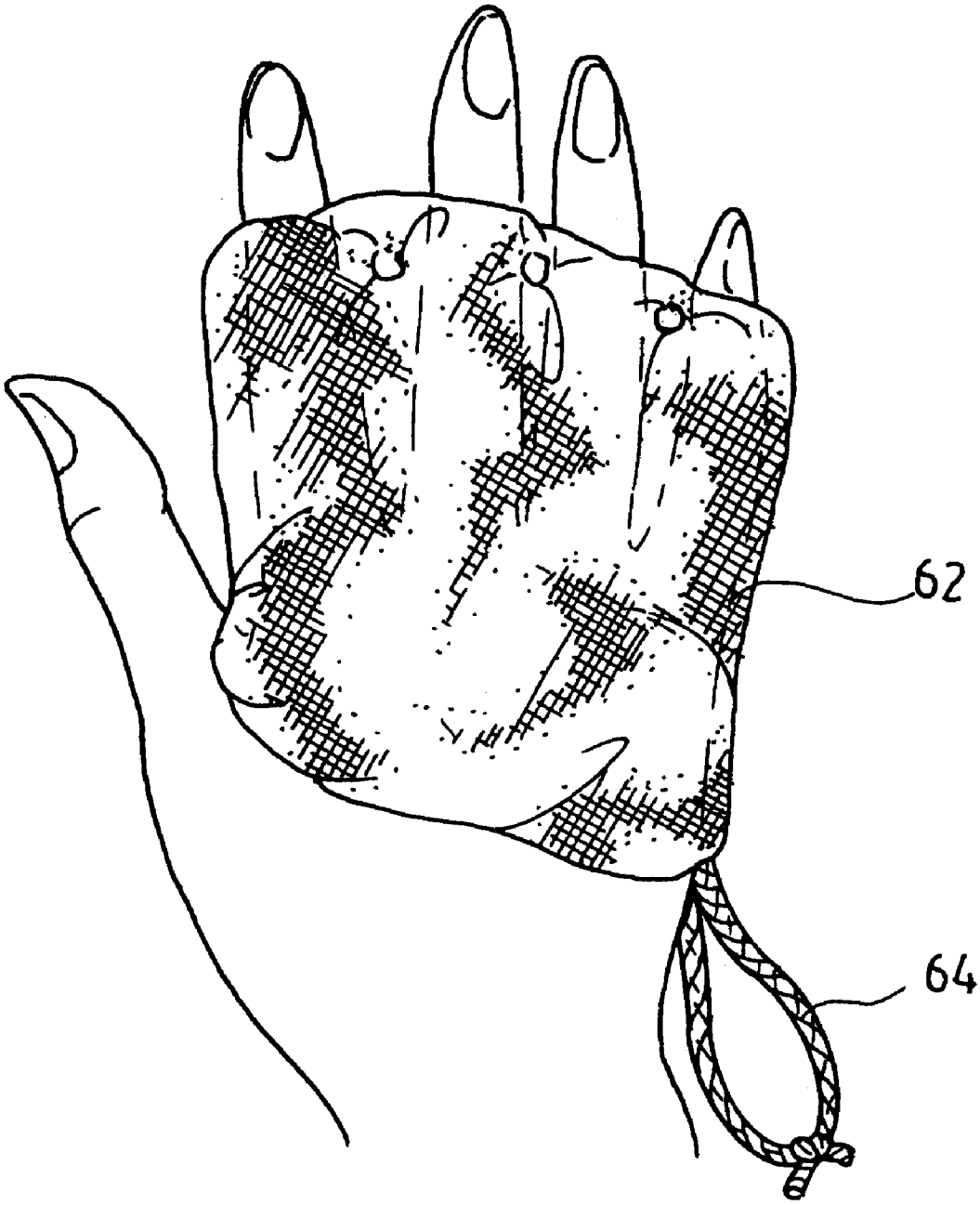
FIG. 12 is an applied view of a bathing brush constructed according to a fifth embodiment of the present invention.
Figure 13:
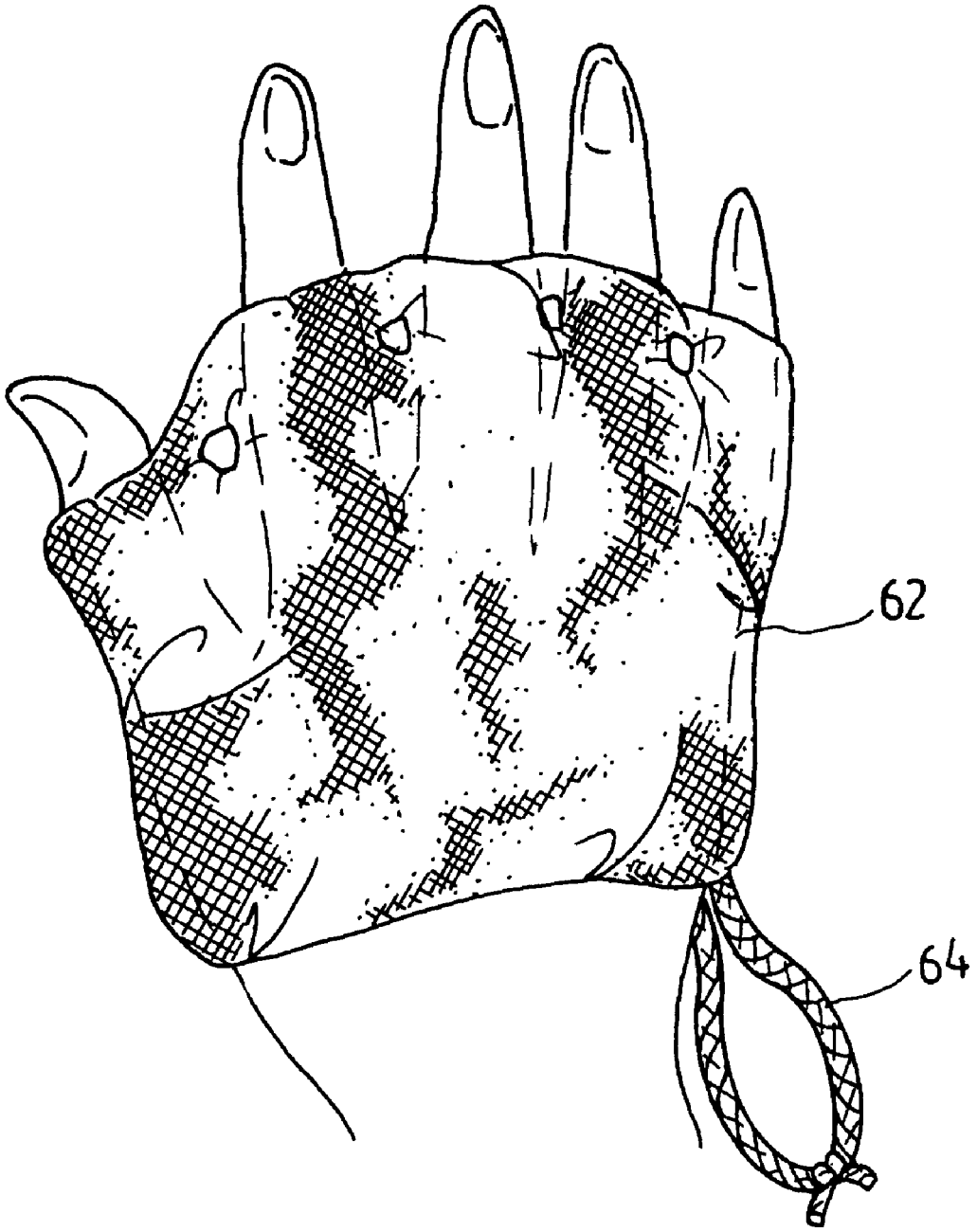
FIG. 13 is an applied view of a bathing brush constructed according to a sixth embodiment of the present invention.

Referring to FIGS. 11, 12 and 13, the folded body, referenced by 62, has one end fixedly mounted with a flexible loop 64, and the other end partly sealed at one (see FIG. 11), three (see FIG. 12), or four points (see FIG. 13), forming a mitt. When putted on the user's fingers, the mitt-like bathing brush does not hinder the movement of the fingers.

While only one embodiment of the present invention has been shown and described, it will be understood that various modifications and changes could be made thereunto without departing from the spirit and scope of the invention disclosed. For example, except the aforesaid sealing process by fusion, stitches can be used to fixedly fasten the inner and outer layers of the folded body and the flexible loop together; multiple meshed tubes can be used and sleeved onto one another for making the desired bathing brush to increase the density of the bathing brush.

What the invention claimed is:

1. A bathing brush fabrication method comprising the steps of:

a) preparing at least one springy meshed tube concentrically arranged together, said at least one springy meshed tube each having a first open end and a second open end;

b) turning said first open end inside out toward said second open end and then turning said second end inside out over said first open end to form a combined end at one end and a folded end at the other end;

c) repeatedly folding said at least one springy meshed tube inside out to form a folded body having an inner layer and an outer layer;

d) preparing a flexible loop, and then inserting a part of said flexible loop into said folded body, keeping a part of said flexible loop disposed outside said folded body;

e) fixedly fastening at least a part of said inner layer and said outer layer to a part of said flexible loop.

2. The bathing brush fabrication method of claim 1 wherein said flexible loop is inserted in between the inner layer and outer layer of said folded body during the step d), and fixedly sealed to a part of said inner layer and a part of said outer layer during the step e).

3. The bathing brush fabrication method of claim 1 wherein said flexible loop is inserted in the axial center of the space defined within said folded body during the step d), and fixedly sealed to a part of said inner layer after at least two locations of said inner layer respectively sealed to two locations of said outer layer during the step e).

4. The bathing brush fabrication method of claim 3 wherein said inner layer have three locations respectively sealed to three locations of said outer layer during the step e).

5. The bathing brush fabrication method of claim 3 wherein said inner layer have four locations respectively sealed to four locations of said outer layer during the step e).

6. The bathing brush fabrication method of claim 1 wherein the step c) of repeatedly folding said at least one springy meshed tube inside out to form a folded body having an inner layer and an outer layer is to fold said combined end inside out toward said folded end.

7. The bathing brush fabrication method of claim 1 wherein the step c) of repeatedly folding said at least one springy meshed tube inside out to form a folded body having an inner layer and an outer layer is to fold said folded end inside out toward said combined end.

8. The bathing brush fabrication method of claim 1 wherein said at least one springy meshed tube is sleeved onto an elongated support means before proceeding to the step b).

9. The bathing brush fabrication method of claim 1 wherein the step a) of preparing at least one springy meshed tube concentrically arranged together is to prepare two springy meshed tubes concentrically put together.

10. The bathing brush fabrication method of claim 1 wherein the fastening of at least a part of said inner layer and said outer layer to a part of said flexible loop during the step e) is achieved by fusion.

11. The bathing brush fabrication method of claim 1 wherein the fastening of at least a part of said inner layer and said outer layer to a part of said flexible loop during the step e) is achieved by stitches.

* * * * *